US007142684B2

(12) United States Patent
Horiuchi et al.

(10) Patent No.: US 7,142,684 B2
(45) **Date of Patent: *Nov. 28, 2006**

(54) MICROPHONE ASSEMBLY

(75) Inventors: Megumi Horiuchi, Yamanashi-ken (JP); Tsutomu Ojima, Iwate-ken (JP)

(73) Assignees: Citizen Electronics Co., Ltd., Yamanashi-ken (JP); Citizen Iwate Co., Ltd., Iwate-ken (JP)

( * ) Notice: Subject to any disclaimer, the term of this patent is extended or adjusted under 35 U.S.C. 154(b) by 281 days.

This patent is subject to a terminal disclaimer.

(21) Appl. No.: 10/146,918

(22) Filed: May 17, 2002

(65) Prior Publication Data

US 2002/0172387 A1 Nov. 21, 2002

(30) Foreign Application Priority Data

May 17, 2001 (JP) ..... 2001-148457

(51) Int. Cl.

*H04R 25/00* (2006.01)

(52) U.S. Cl. ..... 381/361; 381/355; 381/368

(58) Field of Classification Search ..... 381/355, 381/358, 359–369, 170, 324, 173–175, 386, 381/395, 396

See application file for complete search history.

(56) References Cited

U.S. PATENT DOCUMENTS 4,030,396 A * 6/1977 Mariner ..... 310/321
4,697,334 A * 10/1987 Madsen et al. ..... 381/174
6,307,946 B1 * 10/2001 Fujimoto et al. ..... 381/355
6,594,369 B1 * 7/2003 Une ..... 381/174

* cited by examiner

*Primary Examiner*—Suhan Ni
(74) *Attorney, Agent, or Firm*—Dennison, Schultz & MacDonald

(57) ABSTRACT

A microphone assembly comprises a microphone, a connector secured to the underside of the microphone. A gasket has a sound collecting hole and is secured on the upper surface of the microphone.

2 Claims, 7 Drawing Sheets

MICROPHONE ASSEMBLY

BACKGROUND OF THE INVENTION

The present invention relates to a microphone assembly, and more particularly to a small microphone assembly used in a small electronic instrument such as a portable telephone.

FIG. 6 is a sectional view showing a conventional one-piece microphone assembly, and FIGS. 7*a* through 7*c* are an exploded perspective views of the microphone assembly.

The one-piece microphone assembly comprises a condenser microphone 1, a connector 2 secured to the underside of the microphone 1, and a gasket 4 made of elastomer such as silicon rubber and urethane rubber. Each of the connector 2 and the gasket 4 has a dish-like shape, so that the microphone is enclosed by these members. The condenser microphone 1 comprises a substrate, a back plate having a back electrode and a frame having a diaphragm electrode 5. These members are mounted in a case 6.

The connector 2 is made of resin and has a terminal 3 embedded therein so as to be connected to a terminal of an electronic instrument such as a portable telephone when assembled. The gasket 4 is provided for acoustically shielding around the diaphragm electrode 5, and has a sound collection hole 4*a*.

FIG. 8 is a sectional view showing another one-piece microphone assembly similar to the above described microphone assembly.

The microphone assembly comprises the microphone 1, a connector 7, and a cylindrical gasket 8. The microphone 1 is also enclosed by the connector 7 and the gasket 8.

In the conventional microphone assemblies, the gasket, microphone and connector are manufactured at different manufacturers, respectively. These parts are assembled by a final assembling factory. Consequently, there are troubles about storage management of parts and the number of assembling steps.

SUMMARY OF THE INVENTION

An object of the present invention is to provide a microphone assembly which may be easily assembled.

According to the present invention, there is provided a microphone assembly comprising a microphone, a connector secured to an underside of the microphone, and a gasket having a sound collecting hole and secured on an upper surface of the microphone.

The microphone assembly has a square pillar shape.

The present invention further provides a method for manufacturing microphone assemblies comprising the steps of, preparing a connector aggregation having a plurality of divisions, preparing a microphone aggregation having a plurality of divisions, a microphone being provided in each of the divisions, preparing a gasket aggregation having a plurality of divisions, and having a sound collecting hole at each of the divisions, forming each of the divisions into a same shape and a same size, stacking said aggregations and adhering the aggregations to each other to form an aggregation assembly, cutting the aggregation assembly to separate a microphone assembly at each division.

The connector aggregation is made of an anisotropic conductive elastomer.

These and other objects and features of the present invention will become more apparent from the following detailed description with reference to the accompanying drawings.

DETAILED DESCRIPTION OF THE PREFERRED EMBODIMENT

Figure 1:
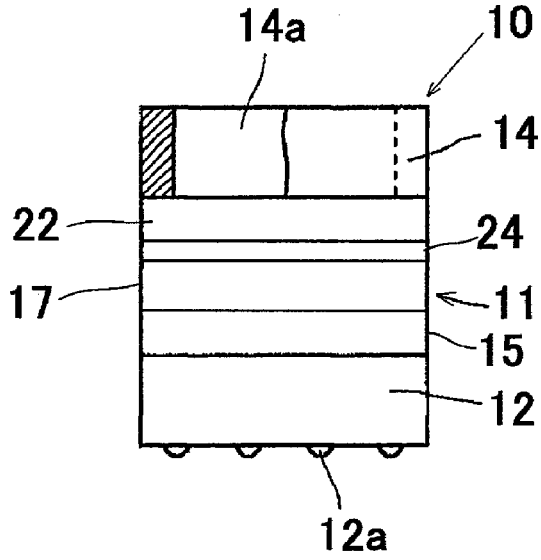
FIG. 1 is a side view of a one-piece microphone assembly of the present invention.
Figure 3A:
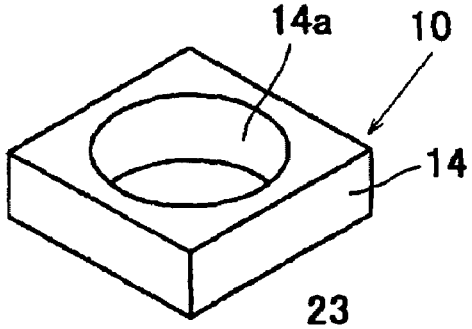
FIGS. 3*a* to 3*c* are an exploded perspective views of the microphone assembly.
Figure 3B:
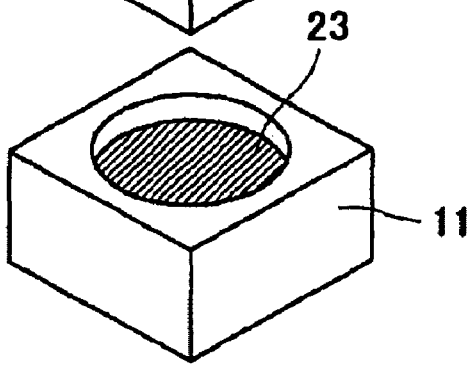
Figure 3C:
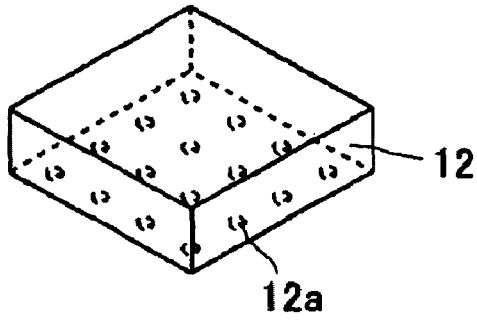

Referring to FIG. 1, the condenser microphone assembly 10 according to the present invention comprises a microphone 11, a connector 12 secured to the underside of the microphone 11 and a gasket 14 secured to the upper surface of the microphone 11. As shown in FIGS. 3*a* to 3*c*, each of these members has a square in plan view. Therefore, the microphone assembly has a cubic shape or square pillar shape.

Figure 2:
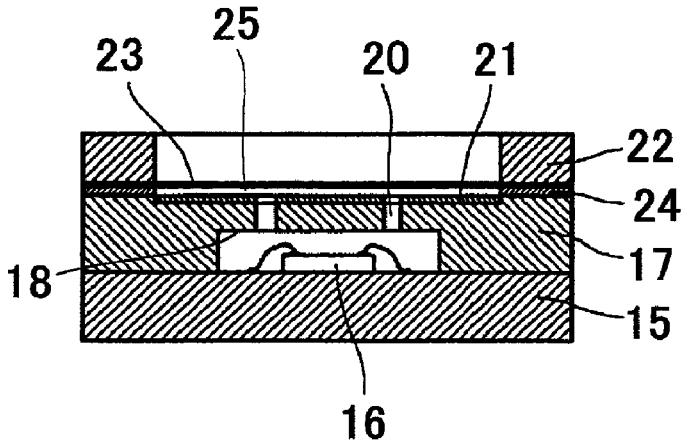
FIG. 2 is a sectional view of a microphone as an example used in the present invention.

Referring to FIG. 2, the microphone 11 comprises a substrate 15 having printed circuits, a field-effect transistor (FET) 16 securely mounted on the substrate 15, having terminal electrodes on the underside thereof, a back plate 17 having a recess 18 for the FET 16 and vents 20 and secured to the substrate 15, a stationary back electrode 21 securely mounted on the surface of the back plate 17, a diaphragm electrode 23 as a movable electrode secured to a spacer 24 mounted on the back plate 17, and a frame 22 mounted on the diaphragm electrode 23. The spacer 24 has an opening 25. The substrate 15, back plate 17, and frame 22 are made of ceramic. The stationary back electrode 21 and the diaphragm electrode 23 form a condenser.

The connector 12 is made of anisotropic conductive elastomer and includes a plurality of gold wires or metal powders therein for electrically connecting the terminal electrodes of the substrate 15 of the microphone 11 and terminals of an electronic instrument in which the microphone assembly is to be mounted. On the underside of the connector 12, there is provided a plurality of projections 12*a* which are formed so as to increase local contact pressure against the terminals of the instrument and to ensure the connection there-between.

The gasket 14 is made of elastomer and has a sound collecting hole 14*a*.

The manufacturing method of the present invention will be described hereinafter.

Figure 4:
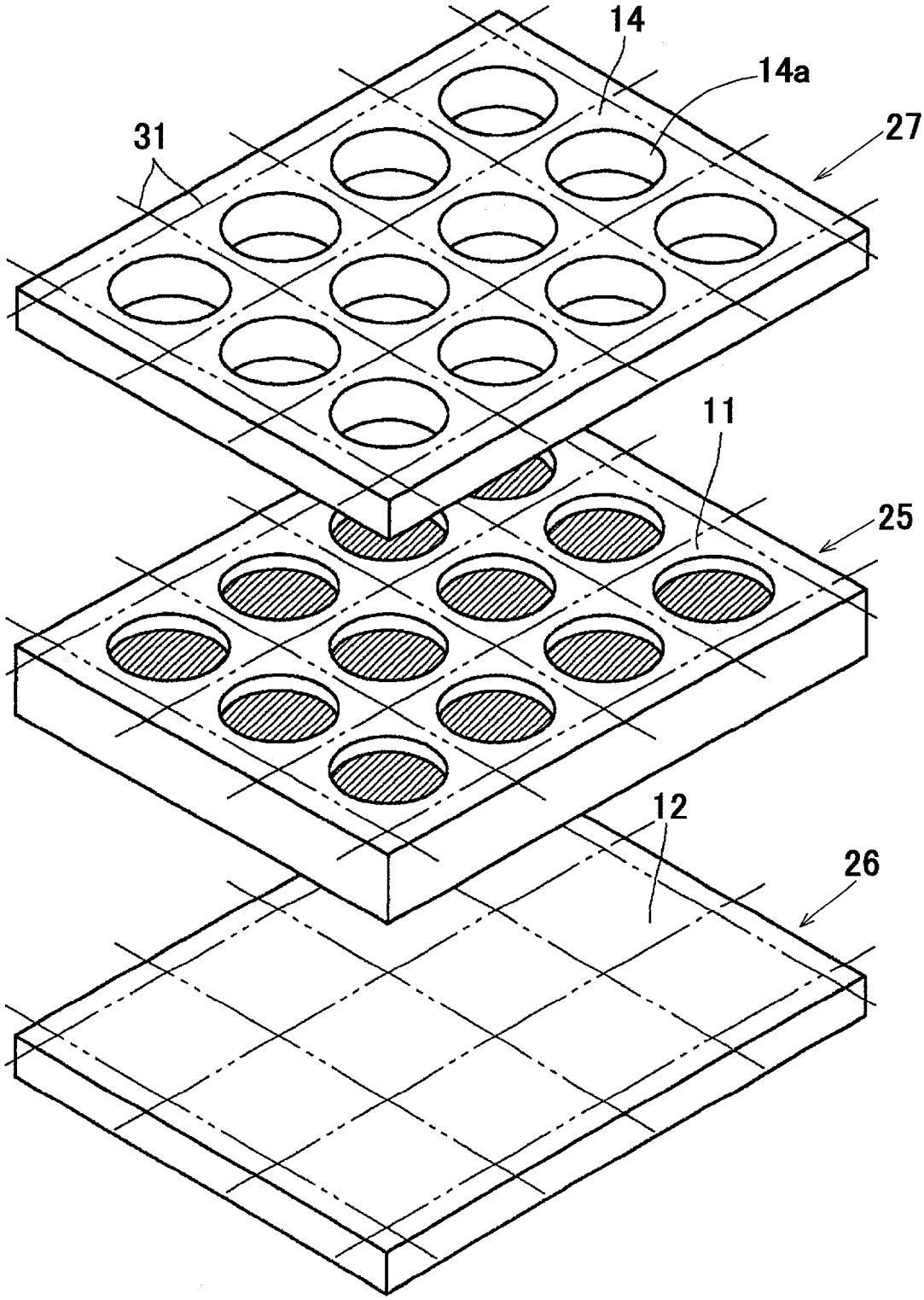
FIG. 4 is a perspective view showing aggregations before assembling.

Referring to FIG. 4, there is provided a microphone aggregation 25, a connector aggregation 26 and a gasket aggregation 27. Each aggregation comprises twelve divisions.

The microphone aggregation 25 is made by stacking the members of the microphone 11 shown in FIG. 2. The connector aggregation 26 is an anisotropic conductive elastomer plate comprising twelve connectors 12 including conductive metal members therein and a plurality of projections 12*a* on the underside thereof. The gasket aggregation 27 is an elastomer plate comprising twelve gaskets 14 each having the sound collecting hole 14*a*.

Figure 5:
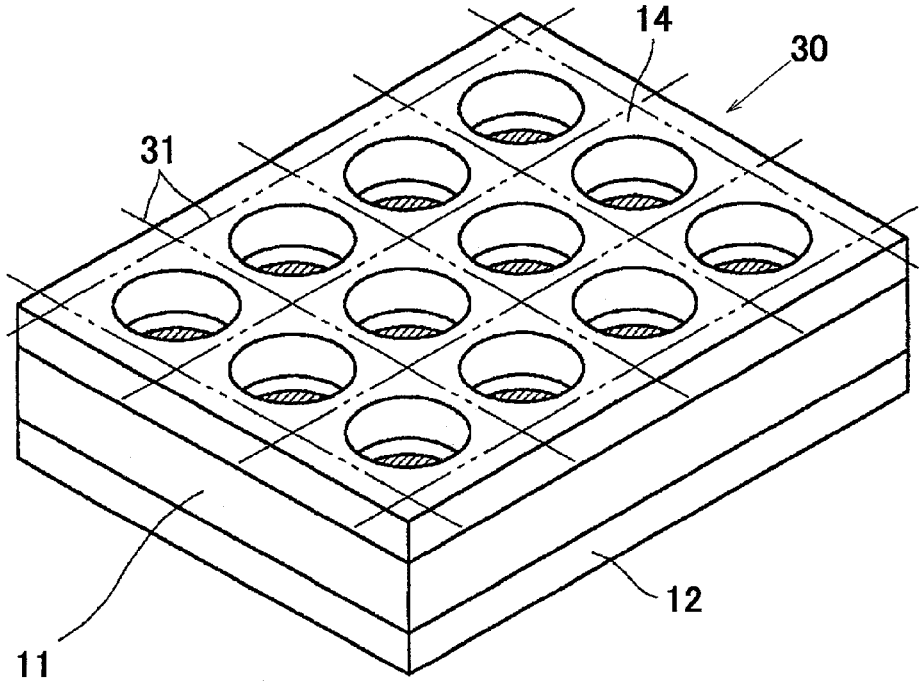
FIG. 5 is a perspective view showing an assembled aggregation.
Figure 6:
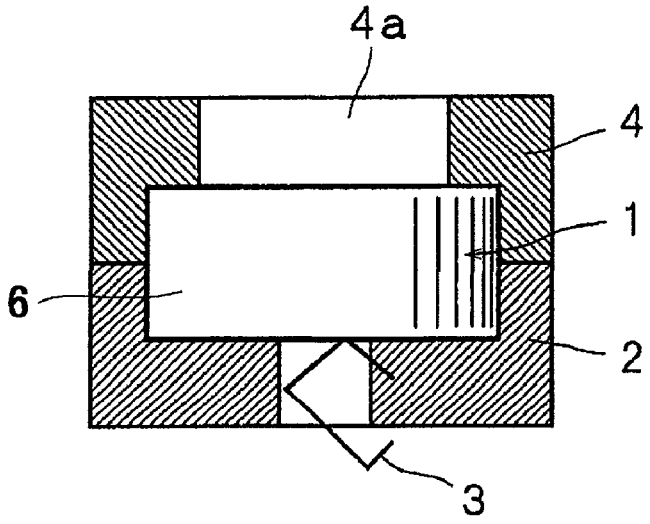
FIG. 6 PRIOR ART
FIG. 6 is a sectional view of a conventional microphone assembly.
Figures 7A, 7B, 7C:
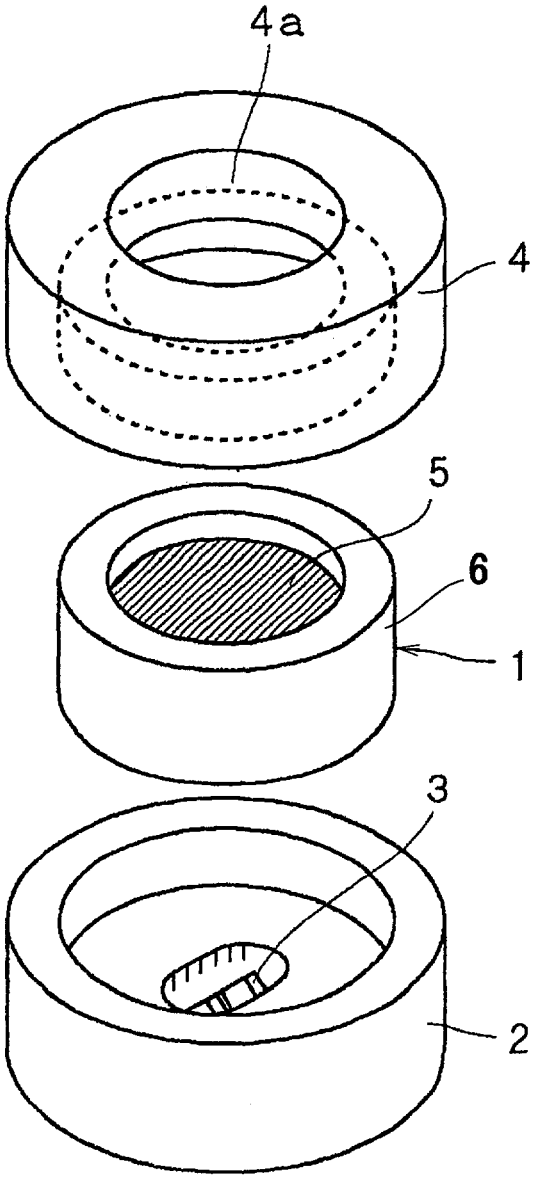
PRIOR ART FIG. 7a
FIGS. 7*a* through 7*c* are exploded perspective views of the microphone assembly.
Figure 8:
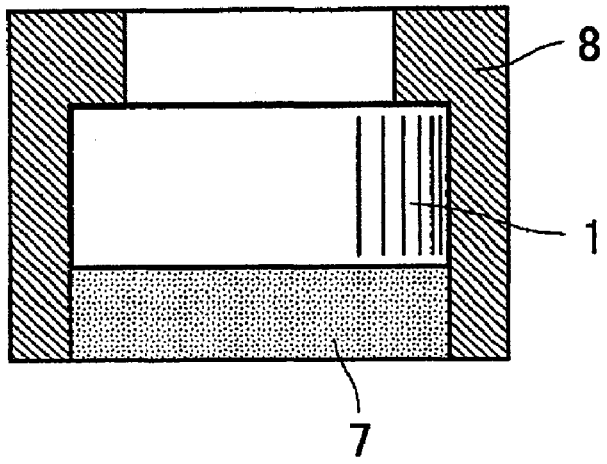
FIG. 8 PRIOR ART
FIG. 8 is a sectional view of another conventional microphone assembly.

The connector aggregation 26, microphone aggregation 25 and gasket aggregation 27 are stacked as shown in FIG. 5 and adhered to each other to form an aggregation assembly 30. The microphone aggregation 25 and the connector aggregation 26 are adhered with an anisotropic conductive adhesive.

The aggregation assembly 30 is cut by a cutter along border lines 31 between the microphone assemblies. Thus, 12 pieces of microphone assemblies are obtained.

In accordance with the present invention, the microphone assembly can be easily manufactured, since the gasket, microphone and connector are simply stacked without surrounding the microphone.

While the invention has been described in conjunction with preferred specific embodiment thereof, it will be understood that this description is intended to illustrate and not limit the scope of the invention, which is defined by the following claims.

What is claimed is:

1. A microphone assembly, comprising:

a connector, a microphone mounted on the connecter;

a gasket mounted on the microphone; wherein the connector is made of conductive material and has a square pillar shape having an upper surface, the microphone has a square pillar shape, and comprises a substrate having a lower surface which is a same size as the upper surface of the connector, an electronic microphone member mounted on the substrate, a back plate provided on the substrate and includes a recess for enclosing the electronic microphone member, vents, and a back electrode and diaphragm electrode mounted over an upper surface of the back plate, and the gasket has a square pillar shape and includes a sound collecting hole, thereby forming a square pillar shaped microphone assembly.

2. The microphone assembly having a square pillar shape according to claim 1 further comprising a plurality of projections provided on an underside of the connector.

* * * * *